US008091979B2

(12) United States Patent
Muhl et al.

(10) Patent No.: US 8,091,979 B2
(45) Date of Patent: Jan. 10, 2012

(54) APPARATUS FOR FREE-SPRAYING AN INKJET PRINTHEAD

(75) Inventors: Wolfgang Muhl, Hohen Neuendorf (DE); Axel Ortmann, Berlin (DE); Marc Tallgau, Berlin (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 596 days.

(21) Appl. No.: 12/334,976

(22) Filed: Dec. 15, 2008

(65) Prior Publication Data

US 2009/0153637 A1 Jun. 18, 2009

(30) Foreign Application Priority Data

Dec. 17, 2007 (DE) ..... 10 2007 060 735

(51) Int. Cl.
*B41J 2/165* (2006.01)

(52) U.S. Cl. ..... 347/35; 347/36

(58) Field of Classification Search ..... None
See application file for complete search history.

(56) References Cited

U.S. PATENT DOCUMENTS

| | | | |
|---|---|---|---|
| 5,806,994 | A | 9/1998 | Coffy et al. |
| 6,390,577 | B1 | 5/2002 | Fajour |
| 2004/0008235 | A1 | 1/2004 | Keyes et al. |
| 2006/0001696 | A1 | 1/2006 | Ha et al. |
| 2007/0120886 | A1 | 5/2007 | Turner et al. |
| 2007/0146415 | A1 | 6/2007 | Jung et al. |

FOREIGN PATENT DOCUMENTS

| | | | |
|---|---|---|---|
| DE | 4000416 | C2 | 7/1991 |
| DE | 102005052151 | B3 | 5/2007 |
| EP | 0696509 | A1 | 2/1996 |
| EP | 0718799 | A2 | 6/1996 |
| FR | 2768078 | A1 | 3/1999 |

OTHER PUBLICATIONS

European Search Report dated Sep. 15, 2009.

*Primary Examiner* — Stephen Meier

*Assistant Examiner* — Tracey McMillion

(74) *Attorney, Agent, or Firm* — Laurence A. Greenberg; Werner H. Stemer; Ralph E. Locher

(57) ABSTRACT

An apparatus for free-spraying an inkjet printhead includes a feed table with a slot carrier which can be deflected counter to a spring force and has at least one free-spraying slot disposed opposite at least one inkjet printhead. The slot carrier is shaped in such a way that the at least one free-spraying slot is deflected out of a transport path corresponding to an entry of an item of mail being fed in.

11 Claims, 4 Drawing Sheets

APPARATUS FOR FREE-SPRAYING AN INKJET PRINTHEAD

CROSS-REFERENCE TO RELATED APPLICATION

This application claims the priority, under 35 U.S.C. §119, of German Patent Application DE 10 2007 060 735.2, filed Dec. 17, 2007; the prior application is herewith incorporated by reference in its entirety.

BACKGROUND OF THE INVENTION

Field of the Invention

The invention relates to an apparatus for free-spraying an inkjet printhead. The invention is used in microprocessor-controlled printers and is suitable for franking machines and other mail processing appliances.

German Patent DE 40 00 416 C2 discloses a method and apparatus for automatically securing the operation of an inkjet printing device, having an inkjet printhead which is moved during printing, on one hand can be cleaned and maintained in a cleaning position and, on the other hand is kept ready to print in a printing pause and can regularly be free-sprayed.

German Published, Non-Prosecuted Patent Application DE 10 2005 052 151 B3, corresponding to U.S. Patent Application Publication No. US 2007/0120886 A1, discloses an apparatus for free-spraying an inkjet printhead of an inkjet printing system, in which the goods to be printed or items of mail are transported past an inkjet printhead that is stationary during printing, and the inkjet printhead is disposed in such a way as to be stationary but pivotable behind a guide plate, and with which, in addition to the usual functions, such as wiping and sealing, free-spraying during the transport of the goods to be printed or the items of mail is also possible. A free-spraying position close to the printing position advantageously permits the relatively long movement times from a printing position to a cleaning and sealing position to be avoided.

U.S. Pat. No. 5,806,994 discloses a franking machine having an inkjet printing and maintenance system which permits periodic free-spraying in the printing position. The items of mail are transported while lying horizontally, and the nozzle surfaces are disposed parallel thereto. In those machines, the nozzles which are used little or not used during printing are free-sprayed as long as there is no letter in front of the printhead. In this way, the consumption of ink is reduced. The free-spraying position is simultaneously the printing position, and thus a procedure for moving the inkjet printhead is omitted. The letter transport device is provided with appropriate cutouts and, underneath the same, there is disposed a collecting container for the free-sprayed ink.

By contrast, in U.S. Pat. No. 6,390,577 it is proposed not to free-spray all of the nozzles but only the unused nozzles when no item of mail comes in front of the printhead or, respectively, shortly before the next item of mail to be printed. The specific free-spraying of the nozzles that are not used for a print prevents a reaction from those then dried-in/blocked nozzles on the entire row of nozzles. In addition, with that selective free-spraying, the number of nozzle actuations of the normally used nozzles can be reduced by precisely those normally printing nozzles not being free-sprayed.

However, in the market segment of franking machines having small to medium-sized mail item throughputs, a compact transport apparatus for items of mail is required, in which the items of mail are not to be contaminated by the free-spraying. In the case of horizontal mail item transport, it is assumed that at least one ink cartridge is disposed above a printing window in the z direction of a Cartesian coordinate system counter to the direction of the force of gravity. During printing, at least one inkjet printhead expels ink drops counter to the z direction in the direction of the force of gravity, which drops fly through a printing window. The printing window is disposed at the edge of a transport belt in the y direction in a housing part. The transport belt transports a flat piece of goods to be printed at the edge in the transport direction x past the at least one printhead during the printing.

SUMMARY OF THE INVENTION

It is accordingly an object of the invention to provide an apparatus for free-spraying an inkjet printhead, which overcomes the hereinafore-mentioned disadvantages of the heretofore-known devices of this general type and which uses a free-spraying slot to reduce ink soiling in a franking machine.

With the foregoing and other objects in view there is provided, in accordance with the invention, an apparatus for free-spraying an inkjet printhead. The apparatus comprises a feed table with a slot carrier which can be deflected counter to a spring force and is equipped with at least one free-spraying slot, that is disposed opposite at least one inkjet printhead. For each inkjet printhead, a free-spraying slot is provided which is integrally molded on a resilient or sprung slot carrier, that is coupled to at least one actuating element and is disposed in a transport path underneath the at least one inkjet printhead, with the feed table containing an opening for the actuating element. The slot carrier is shaped in such a way that the at least one free-spraying slot is deflected out of the transport path corresponding to an entry of an item of mail that is fed in.

One free-spraying slot is used for each inkjet printhead. Depending on the number of inkjet printheads, one or two free-spraying slots are used, which are coupled to a resilient or sprung slot carrier having at least one actuating element and are disposed in the transport path underneath the printheads. Through the use of the spring action, free-spraying slots are brought close to the inkjet printheads, so that all of the jets of ink are in the interior of the free-spraying slots. During the intermediate wait for items of mail, it is possible to spray free into the slots through the use of this configuration. The free-spraying position is the printing position. During printing, the inkjet printheads remain stationed in the printing position and only the at least one free-spraying slot is moved away from the inkjet printhead. No separate motor is required for this purpose.

During the entry of an item of mail or a flat piece of goods, which is moved over the feed table, the actuating element, which is equipped with a guide cam, is actuated and the slot carrier having the free-spraying slots is moved out downward from the transport path of the items of mail, counter to a spring force. Printing of the items of mail can then be implemented. The passage of the items of mail is monitored by sensors. Following the passage of the items of mail, the slot carrier having the free-spraying slots is moved back into the position under the inkjet printheads due to the spring action, in order to permit further free-spraying as soon as the aforementioned sensors report to a controller that the transport path for items of mail is free of items of mail. The inkjet printheads are then driven appropriately in order to trigger the free-spraying.

The advantage is that immediate free-spraying in the printing position is made possible without the inkjet printheads previously having to be moved. A further advantage is that no separate drive is needed to move the slot carrier.

The resilient or sprung slot carrier is mounted on one side in such a way that it can rotate on an axis of rotation underneath a mail feed table and, at the other end, has at least one free-spraying slot, which projects in the z direction through an associated opening in the mail feed table. Further openings are provided in the mail feed table for a free-spraying slot, for a device for pressing on and supporting an item of mail and for the at least one actuating element of the slot carrier, which projects in the z direction through an associated opening in each case.

A transport apparatus is disposed horizontally and in a stationary manner in the printing apparatus in the z direction opposite a non-illustrated pressing device which presses the item of mail on to a transport belt of the transport apparatus. In the transport region, the transport belt acts with a predetermined adhesive friction on a part of the surface of the item of mail which is not printed. The transport belt is preferably a driven, wide, tensioned flat belt.

Other features which are considered as characteristic for the invention are set forth in the appended claims.

Although the invention is illustrated and described herein as embodied in an apparatus for free-spraying an inkjet printhead, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
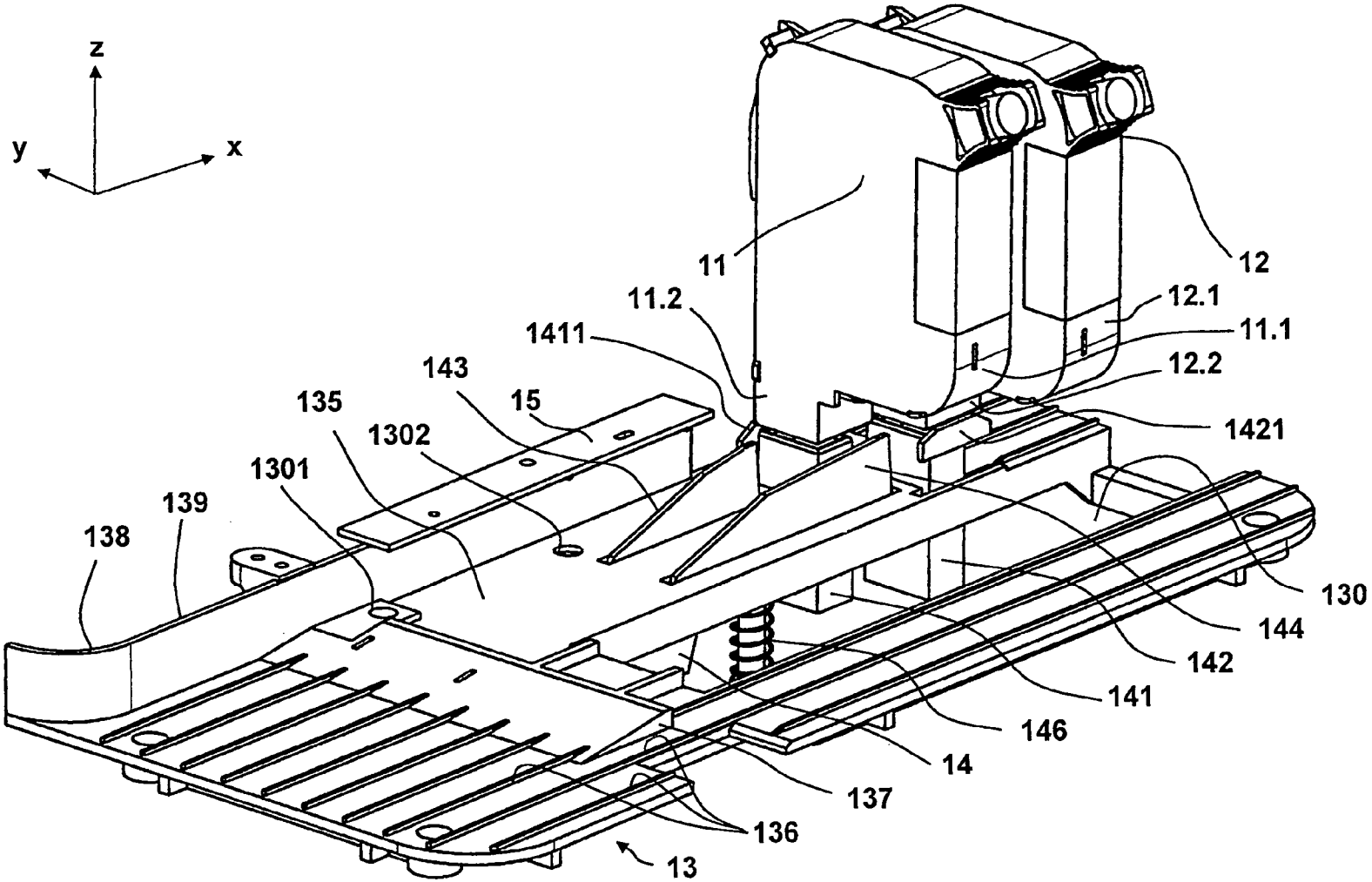
FIG. 1A is a diagrammatic, perspective view of an apparatus for free-spraying an inkjet printhead with a position of a slot carrier in a transport path during a free-spraying.

Referring now to the figures of the drawings in detail and first, particularly, to FIG. 1A thereof, there is seen a perspective view of an apparatus for free-spraying an inkjet printhead, which is illustrated from the front top left with a position of a slot carrier in a transport path during a free-spraying. A feed table 13 for flat goods is shown together with two ink cartridges 11, 12 of a printing module in a printing and free-spraying position in a first time interval, in which no flat goods are being fed in. A non-illustrated transport apparatus for flat goods or items of mail is disposed above the feed table 13, but has been omitted for reasons of improved clarity. A likewise non-illustrated pressure device for flat goods or items of mail, which presses against them in a resilient or sprung manner from below, is disposed underneath the feed table.

Figure 1B:
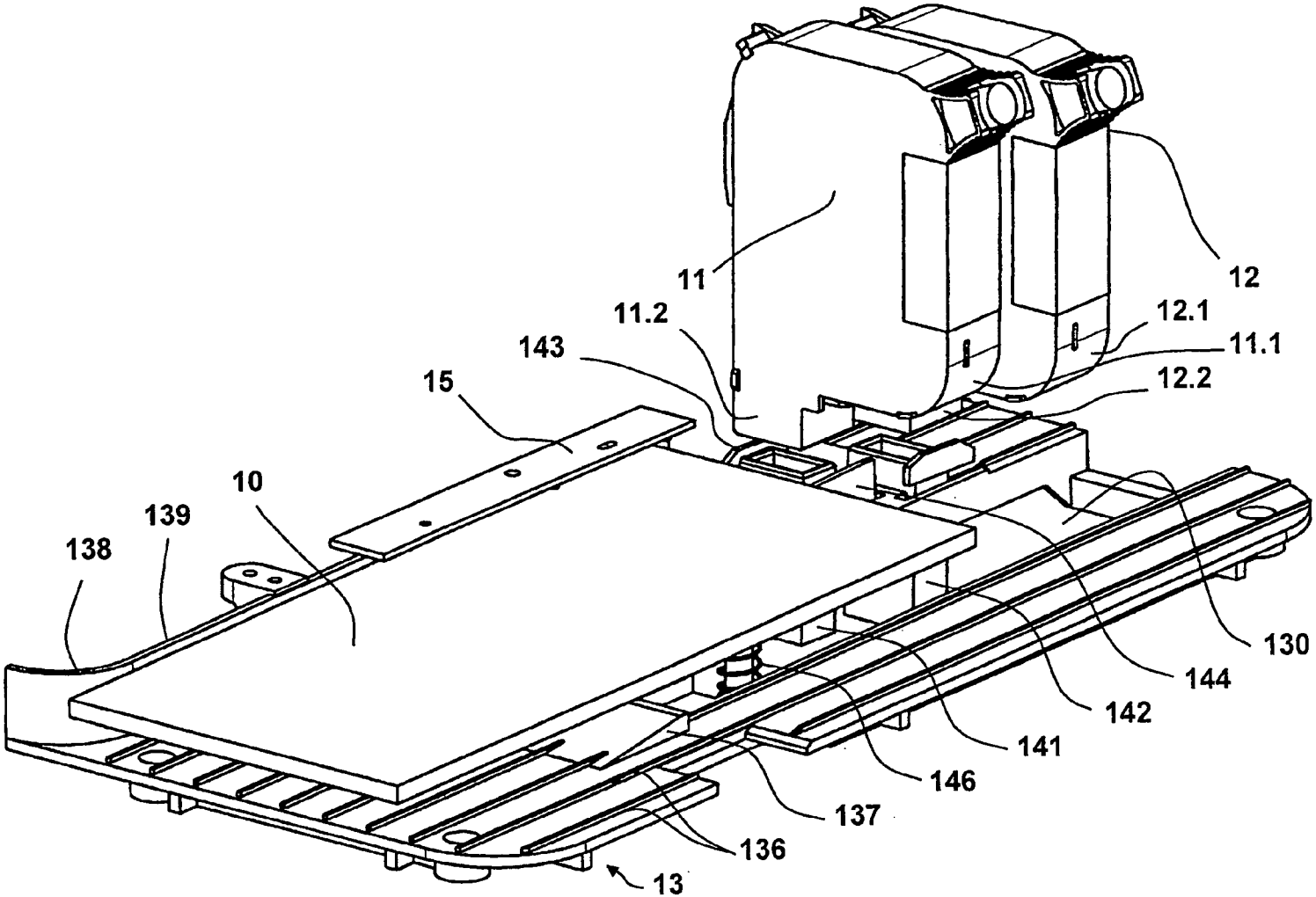
FIG. 1B is a perspective view of an apparatus for free-spraying an inkjet printhead with a position of a slot carrier in a transport path shortly before printing.

The feed table 13 has a base plate 135 and, on an output side of a stream of mail, a large rectangular opening 130 for the aforementioned pressing device. On an input side of the stream of mail, in a feed region, the feed table 13 has slide rails 136, which are molded integrally or in one piece on the base plate 135 and reduce sliding friction for flat goods being fed in. A ramp 137, which is disposed between the feed region and the rectangular opening 130, raises a front edge of the flat goods being fed in. Elongated, ramp-like guide fins 143, 144, which act as an actuating element of a slot carrier 14, are disposed upstream of the stream of mail and positioned before respective window openings, in which a respective free-spraying slot 141, 142 is disposed in each case in such a way that it can move. An upper edge of each free-spraying slot 141, 142 is equipped with a guide fin 1411, 1421. Through the interaction of all of the fins, the slot carrier 14 is moved downward in the direction of the force of gravity, counter to a spring force of a compression spring 146, in accordance with a guide cam, by a flat piece of goods or item of mail 10 entering upstream of the stream of mail, as is illustrated in FIG. 1B. Inkjet printheads 11.2 and 12.2 of the ink cartridges 11, 12 are disposed in the printing position in a z direction, i.e. counter to the force of gravity, immediately above a respective printing window or free-spraying slot 141, 142. Bulges or expansions 11.1 and 12.1 of the ink cartridges 11, 12 are disposed transversely with respect to the transport direction and counter to a y direction. In the feed region, a guide wall 139 running in the transport direction and extending orthogonally in the z direction is molded integrally or in one piece on the base plate 135 and widens in an entry region 138 for flat goods or items of mail. The flat goods or items of mail are registered through the use of sensors after running over the ramp 137. Holes 1301, 1302 and 1303 (not visible in FIG. 1A, but seen in FIG. 2), which are molded into the base plate 135, are provided for transmitting diodes of the sensors. A carrier plate 15 can accommodate phototransistors or photodiodes. The transmitting diodes and phototransistors or photodiodes are a component part of transmitted light barriers.

A perspective view of an apparatus for free-spraying an inkjet printhead is illustrated in FIG. 1B, from the front top left with the position of a slot carrier in the transport path shortly before printing. The feed table 13 for flat goods is shown together with a printing module in a printing and free-spraying position and with a flat piece of goods 10, which is fed in during a second time interval and is moved over the slide rails 136 and the ramp 137. In this case, beginning from the contact with the guide fins 143, 144, the front edge of the flat piece of goods 10 moves the slot carrier 14 downward counter to the spring force which is applied by the compression spring 146. Since the upper edge of each free-spraying slot 141,142 is also equipped with a guide fin 1411, 1421, the flat piece of goods consequently passes into an interspace between the inkjet printheads 11.2, 12.2 of the ink cartridges 11, 12 and the upper edge of each free-spraying slot 141, 142 without a jam occurring.

Figure 2:
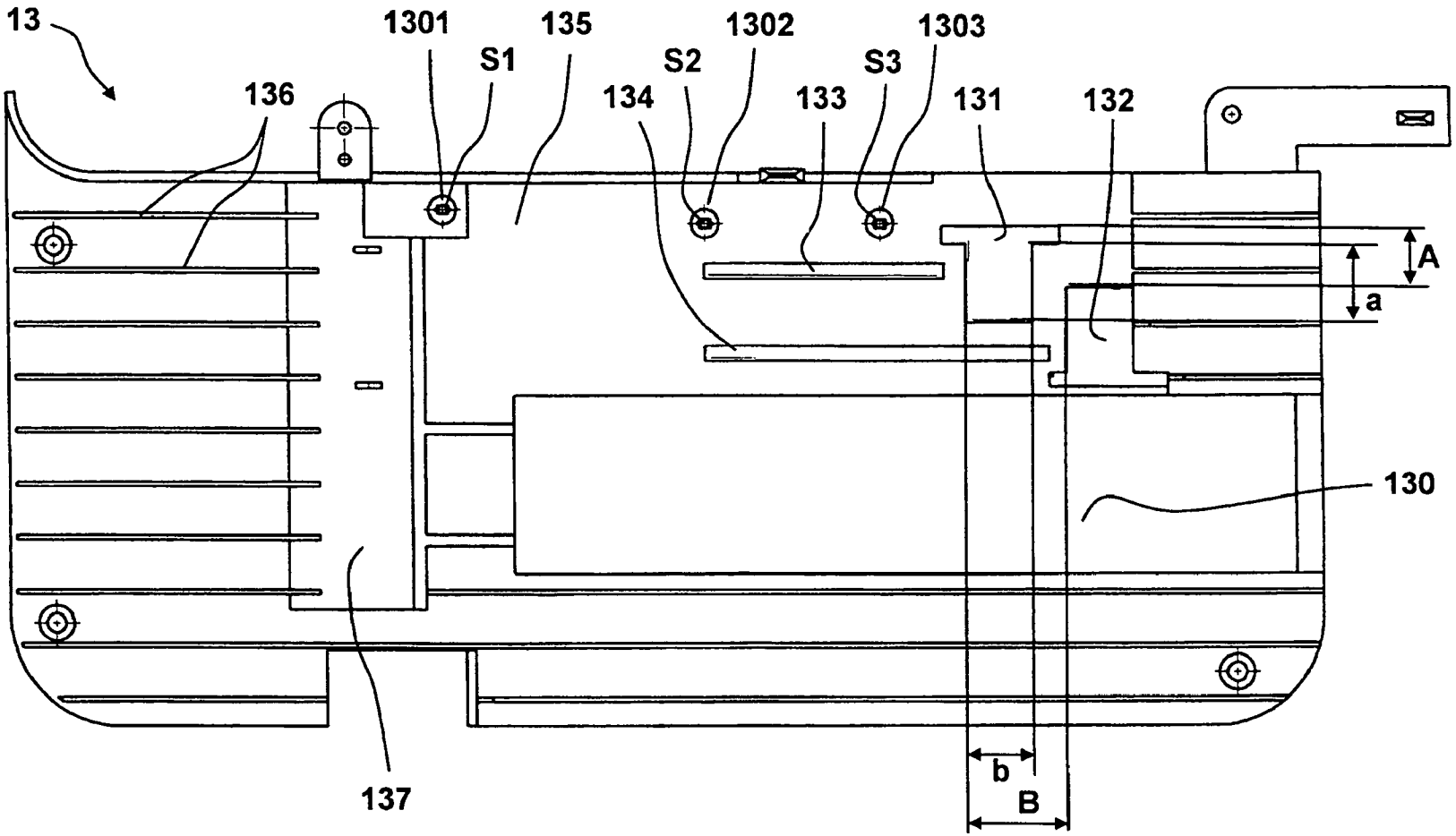
FIG. 2 is a top-plan view of a feed table.

FIG. 2 shows a plan view of a feed table 13, on which items of mail can be fed in from the left, with a non-illustrated underside of the item of mail, which is not to be printed, facing a running surface of the base plate 135 of the feed table 13. The running surface of the base plate 135 is disposed after the ramp 137 in the transport direction x of the items of mail and has a medium-sized first opening 131 and a medium-sized second opening 132 opposite the inkjet printheads. The first opening 131 is disposed offset with respect to the second opening 132 by a first distance A in the y direction, i.e. in the transverse direction in relation to the transport direction of the items of mail. The first distance A is somewhat less than an entire printhead length a of a ½" HP printhead. The second opening 132 is disposed offset with respect to the first opening 131 by a second distance B in the x direction, i.e. in the transport direction of the items of mail, with that distance being more than a whole printhead width b. The printhead length a and the printhead width b correspond in length and width to internal dimensions of each slot opening. Both the first and second openings 131 and 132 in the feed table 13 are π-shaped (in the shape of the Greek letter pi) in accordance with the dimensions of the respective cross section of the free-spraying slot 141, 142 and the guide fin 1411, 1421.

The running surface of the base plate 135 also has the relatively large rectangular third opening 130 extending in the transport direction x of the items of mail, with its area exceeding the area of the medium-sized second opening 132 by more than an order of magnitude. The second opening 132 is offset in the y direction in relation to the third opening 130, with the offset being so minimal that the two openings are immediately adjacent each other or are separated by only a very thin connecting web. The third opening 130 permits elements of the non-illustrated resilient or sprung pressure device, which presses against a flat piece of goods or item of mail and is disposed underneath the feed table, to pass through. A respective elongated rectangular opening 133,134 is positioned before each of the two first and second openings 131 and 132, upstream of the stream of mail. In addition, the openings 1301, 1302 and 1303 for sensors S1, S2 and S3 are disposed in the feed table.

Figure 3:
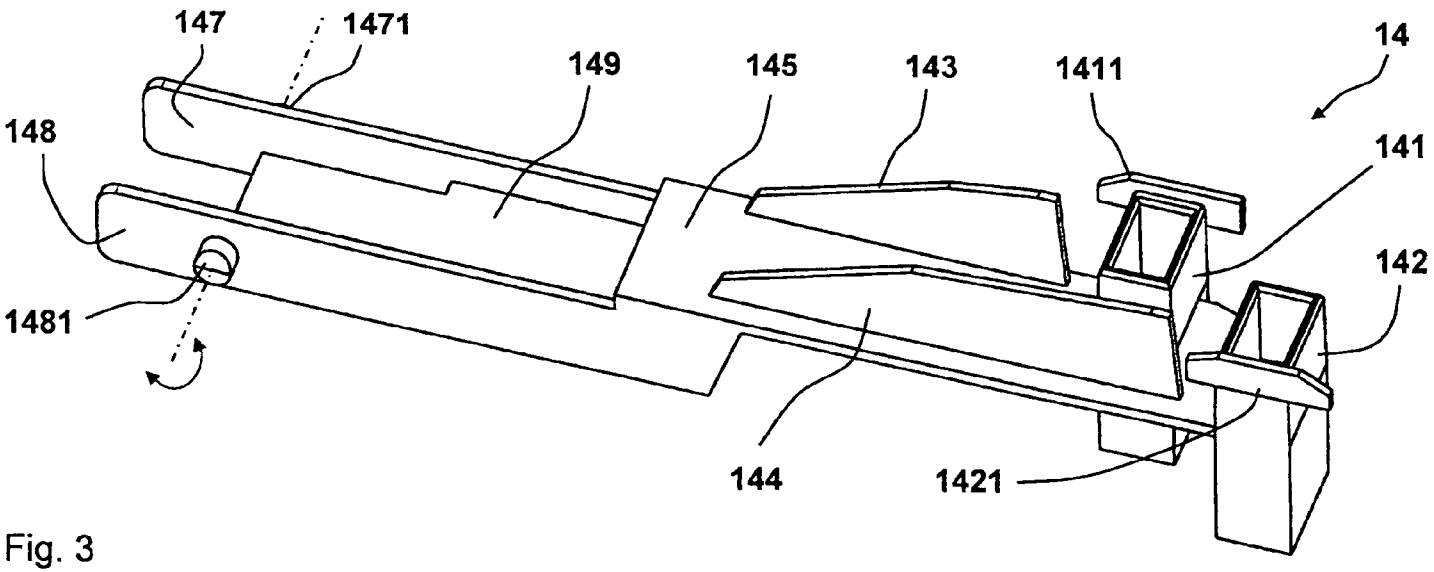
FIG. 3 is a perspective view of a slot carrier as seen from the front top right.

FIG. 3 illustrates a perspective view of a slot carrier 14 from the front top right. The slot carrier 14 has two side plates 147,148, which carry bearing pins 1471, 1481 at a first end, disposed upstream of the stream of mail, and the two free-spraying slots 141, 142 at a second end. The free-spraying slots 141, 142 are located downstream of the stream of mail, projecting in the z direction and standing on a base area 145. An upper edge of each free-spraying slot 141, 142 is equipped with one of the guide fins 1411, 1421. The guide fins are formed in such a way that it is not possible for an edge of a flat item of mail to catch on an upper slot edge during the transport of an item of mail. The slot carrier is moved downward out of the transport path of the items of mail, counter to a spring force, through the use of the edge which slides along on the edge of the guide fin. In each case, one of the elongated ramp-like guide fins 143, 144 is placed before a respective one of the two free-spraying slots 141, 142 as an actuating element disposed upstream of the stream of mail, so that the slot carrier 14, in interaction with all of the fins, is equipped with a guide cam for items of mail entering upstream of the stream of mail. The cam moves the slot carrier 14 with the free-spraying slots 141, 142 downward out of the transport path of the items of mail without the position of the item of mail being changed as a result. The slot carrier 14 has an elongated shape, with its side plates 147, 148 being molded integrally or in one piece and angled-over through 90° on the base area 145 in the center of the slot carrier 14. The two side plates 147, 148 are spaced apart from each other by a spacer plate 149. The transition from the spacer plate 149 to the base area 145 is formed in the center of the slot carrier 14 as a step, with the base area 145 being disposed closer to the base plate 135 of the feed table 13 than the spacer plate 149 after the slot carrier 14 has been mounted.

The bearing pins 1471, 1481 of the side plates 147, 148 at the first end of the slot carrier 14, disposed upstream of the stream of mail, are mounted on the underside in such a way that they can move in rotation in corresponding mountings on the feed table 13. The base area 145 of the slot carrier 14 therefore lies under the base plate 135 of the feed table 13, approximately parallel to an x/y plane, when no flat piece of goods or item of mail is being fed in.

The apparatus for free-spraying an inkjet printhead is used in microprocessor-controlled printers, for example in a franking machine for franking items of mail. As is known, a franking machine includes, inter alia, a non-illustrated electronic part (meter) and the transport apparatus for items of mail with a non-illustrated electronic controller. A keyboard and a display unit of the meter are connected to the electronic part in a non-illustrated manner.

Figure 4:
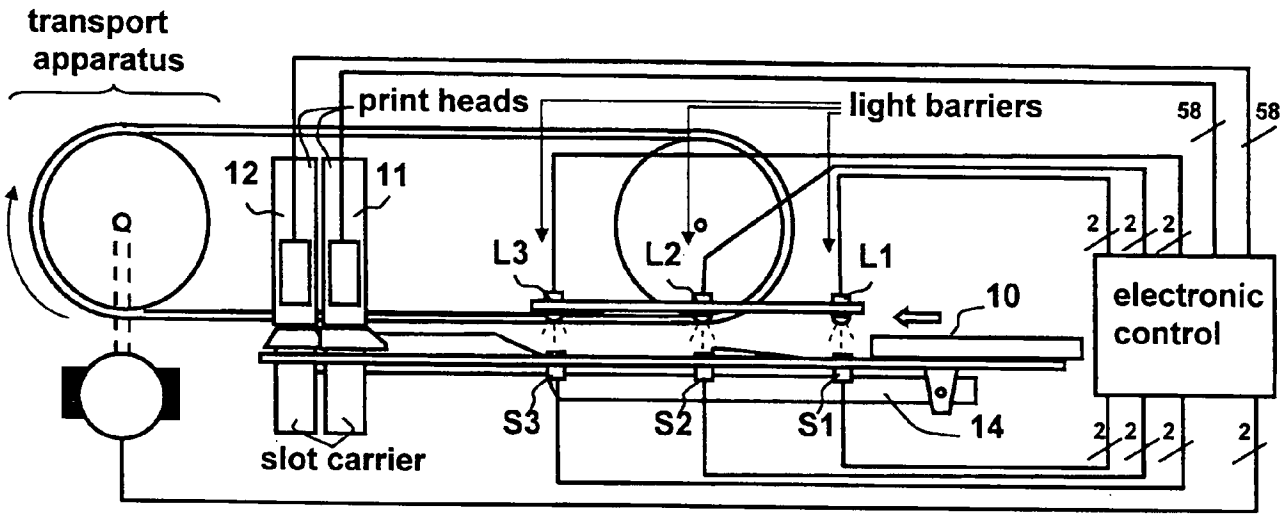
FIG. 4 is a schematic and block wiring diagram.

FIG. 4 is a wiring diagram showing an electronic control connected electrically firstly to the transport apparatus and to sensors S1, S2 and S3, including light barriers, and secondly to the inkjet printheads of cartridges 11, 12 in order to drive the latter. The feeding of an item of mail or a flat piece of goods 10 or the absence of the latter in the transport path can be established through the use of the light barriers and the electronic controller.

The invention is not restricted to the present embodiment per se. Instead, a number of devices are conceivable within the scope of the claims, which are used and which, starting from the same basic concept of the invention, are covered by the appended claims.

The invention claimed is:

1. An apparatus for free-spraying an inkjet printhead, the apparatus comprising:

a feed table having a slot carrier to be deflected counter to a spring force;

said slot carrier having at least one free-spraying slot disposed opposite at least one inkjet printhead; and said slot carrier being shaped to deflect said at least one free-spraying slot out of a transport path corresponding to an entry of an item of mail being fed in.

2. The apparatus according to claim 1, wherein the at least one inkjet printhead is disposed above said feed table in a printing position, and a free-spraying position is identical with said printing position.

3. The apparatus according to claim 1, which further comprises:

at least one actuating element;

said at least one free-spraying slot including a free-spraying slot associated with each respective inkjet printhead and integrally molded on said slot carrier;

said at least one free-spraying slot being coupled to said at least one actuating element and disposed in said transport path underneath the at least one inkjet printhead;

said feed table containing an opening for said at least one actuating element; and said at least one actuating element of said slot carrier having a guide cam for moving said slot carrier with said at least one free-spraying slot downward upon moving a flat piece of goods or item of mail over said feed table.

4. The apparatus according to claim 3, wherein said at least one free-spraying slot includes two free-spraying slots, and said at least one actuating element includes two elongated ramp-shaped guide fins each positioned before a respective one of said two free-spraying slots upstream of a stream of mail.

5. The apparatus according to claim 4, wherein:

said feed table has a running surface;

said feed table has first and second openings for said two free-spraying slots;

said feed table has elongated rectangular openings each disposed before a respective one of said first and second openings upstream of the stream of mail for said ramp-like guide fins; and said feed table has a third opening in said running surface permitting elements of a pressure device pressing in a sprung manner against a flat piece of goods or item of mail and disposed underneath said feed table to pass through.

6. The apparatus according to claim 5, wherein:

said third opening extends in a transport direction x of the items of mail and has a rectangular area exceeding an area of said second opening by more than an order of magnitude; and said second opening has an offset in a y direction relative to said third opening, said offset being minimal enough to permit said second and third openings to be immediately adjacent each other or be separated only by a very thin connecting web.

7. The apparatus according to claim 5, wherein each of said free-spraying slots has an upper edge with a guide fin, and said first and second openings are each formed in said feed table in accordance with dimensions of a cross section of a respective one of said free-spraying slots and said guide fins.

8. The apparatus according to claim 4, wherein said slot carrier has a base area, and said free-spraying slots and said elongated ramp-shaped guide fins are integrally molded on said base area.

9. The apparatus according to claim 1, wherein:

said slot carrier has a base area, a center, a spacer plate and two side plates having first and second ends and being integrally molded and angled-over through 90° on said base area in said center;

bearing pins are disposed at said first end of said side plates upstream of a stream of mail and spaced apart from each other by said spacer plate;

said at least one free-spraying slot is two free-spraying slots disposed at said second end of said side plates, downstream of the stream of mail, said two free-spraying slots projecting in a z direction and standing on said base area; and a step forms a transition from said spacer plate to said base area at said center of said slot carrier.

10. The apparatus according to claim 9, wherein:

said bearing pins are mounted on an outside of said side plates for movement in rotation in corresponding mountings on an underside of said feed table;

said feed table has a base plate;

said base area is disposed closer to said base plate than said spacer plate after mounting said slot carrier; and said base area lies under said base plate approximately parallel to an x/y plane, when no flat piece of goods or item of mail is being fed in.

11. The apparatus according to claim 1, wherein said feed table has openings for sensors, and an electronic controller of a franking machine is connected electrically firstly to the inkjet printheads for driving the inkjet printheads and secondly to a transport apparatus and to sensors, including light barriers, for driving the light barriers to establish feeding in of an item of mail or a flat piece of goods or an absence of an item of mail or a flat piece of goods in the transport path.

* * * * *